United States Patent [19]

Holden

[11] 4,397,107

[45] Aug. 9, 1983

[54] BULLET DROP COMPENSATING SCOPE MOUNT

[76] Inventor: Gerald B. Holden, 35992 Dover, Livonia, Mich. 48150

[21] Appl. No.: 211,136

[22] Filed: Nov. 28, 1980

[51] Int. Cl.[3] ..... F41G 1/38

[52] U.S. Cl. ..... 42/1 ST; 33/248

[58] Field of Search ..... 42/1 ST; 33/248, 247, 33/245

[56] References Cited

U.S. PATENT DOCUMENTS

| | | | |
|---|---|---|---|
| 2,101,037 | 12/1937 | O'Neil | 33/248 |
| 2,143,167 | 1/1939 | Pechar | 33/248 |
| 2,237,395 | 4/1941 | Sweet | 33/248 |
| 2,336,107 | 12/1943 | Litschert | 33/248 |
| 4,205,473 | 6/1980 | Wilson | 42/1 ST |

*Primary Examiner*—Charles T. Jordan

*Attorney, Agent, or Firm*—Burton, Parker & Schramm

[57] ABSTRACT

A bullet drop compensating telescope mount having a front mounting ring pivotally mounted to the rifle and a rear mounting ring for vertically adjusting the telescope position therein by means of an adjusting screw having a thread pitch corresponding to a bullet weight to be fired from the rifle. A dial graduated in distance increments is attached to the adjusting screw, and a pair of positioning pads limit lateral movement of the telescope in the rear mount.

1 Claim, 5 Drawing Figures

BULLET DROP COMPENSATING SCOPE MOUNT

DESCRIPTION

Field of Invention

This invention relates to telescopic sight mounts for rifles and the like.

BACKGROUND OF THE INVENTION

There has been a need for a scope mount for rifles and the like which would enable the shooter to quickly adjust for changes in range of the target. For example, it would be desirable to be able to sight in a rifle 100 yards, and after that simply dial the range the shooter wants. Prior forms of scope mounts have not permitted this simplified arrangement to enable compensating for bullet drop. In addition, prior forms of scope mounts have not enabled manufactures of a line of mounts for different bullet weights with only a minimum change in the design to accommodate the various weights.

SUMMARY OF THE INVENTION

In carrying out the invention I have discovered that a scope mount may be provided which will securely lock the scope on the rifle against longitudinal movement, and which at the same time will permit quick and easy adjustment of the scope to compensate for bullet drop at varying ranges. The mount includes front and rear mounting rings, each having separable halves enabling the scope to be mounted therein. The front ring includes a pivotal support for mounting the ring for fore and aft rocking motion on the rifle. The front ring is intended to be clamped firmly about the scope to lock the scope against longitudinal movement. The rear of the scope is intended to float within the rear ring. Vertical adjustment means are provided on the rear ring, including a dial graduated in accordance with distance ranges, enabling the shooter to readily adjust the scope for bullet drop at varying ranges. The vertical adjustment means is designed to accommodate the particular bullet weight with which the rifle is to be used.

BRIEF DESCRIPTION OF PREFERRED EMBODIMENT

Figure 1:
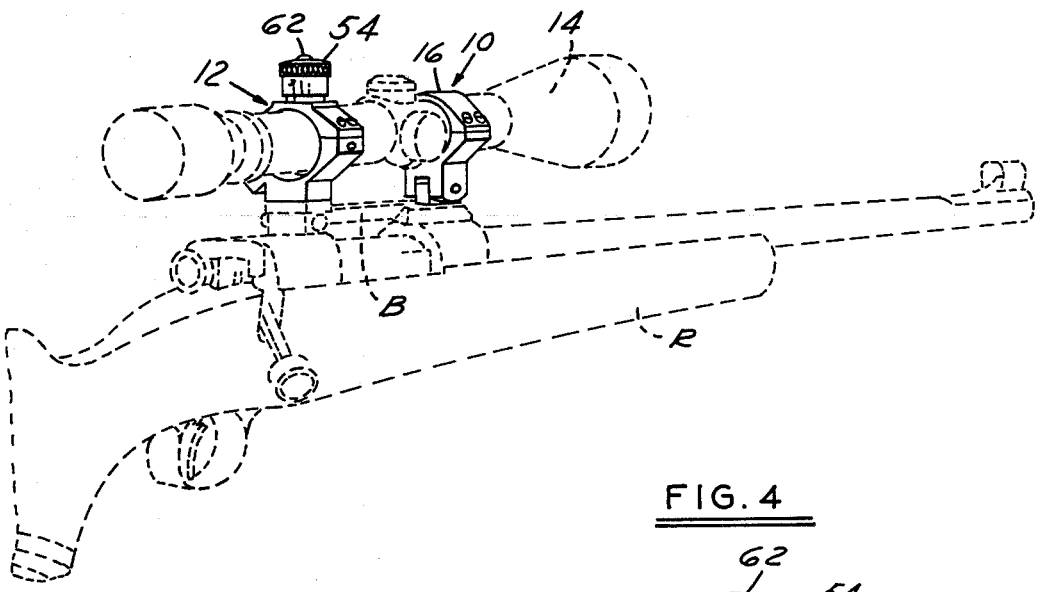
FIG. 1 is a perspective view showing my improved bullet drop compensating scope mount on a rifle and carrying a scope, the rifle and scope being shown in phantom outline.
Figure 2:
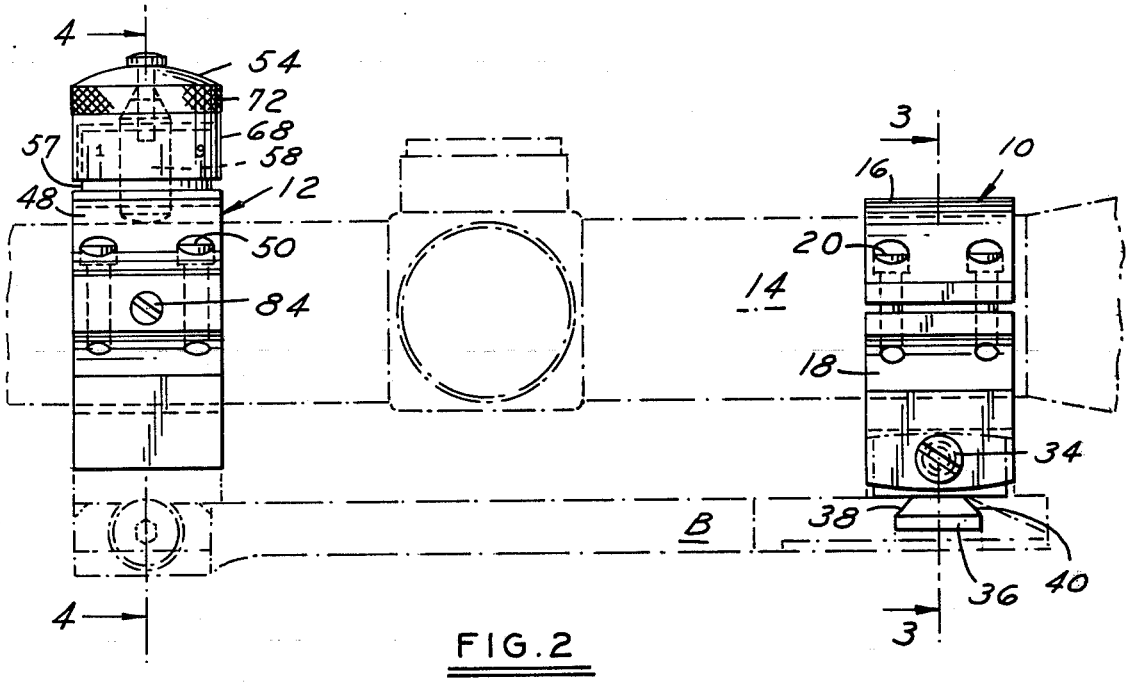
FIG. 2 is a side elevation of my improved mount.

My improved bullet drop compensating scope mount is shown in FIGS. 1 and 2 as comprising front and rear rings 10 and 12 respectively adapted to embrace a scope 14 disposed therein and support the scope on the rifle R as shown in FIG. 1. Each of the rings includes separable upper and lower halves permitting the scope to be mounted in the rings.

Figure 3:
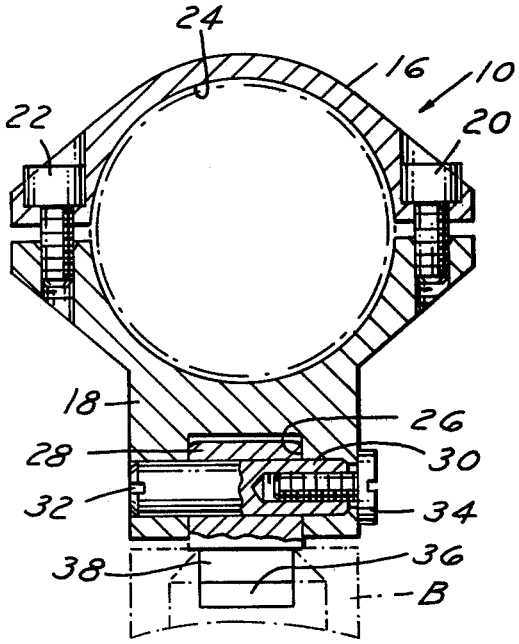
FIG. 3 is a cross-sectional view taken on a line 3—3 of FIG. 2.

The front ring 10 includes an upper half 16 and a cooperating lower half 18 with four screw threaded fasteners, two of which are shown at 20 and 22 in FIG. 3, extending through drilled holes in the upper half 16 and threadedly engaged within lower half 18. The internal diameter surface 24 is such that upon tightening the screws the ring may be tightly clamped about the scope to lock the same within the ring against relative movement. This is an important feature in preventing displacement of the scope during firing of the rifle.

The front ring is supported for fore and aft rocking motion on the rifle about a transverse axis extending perpendicular to a vertical plane extending longitudinally of the rifle barrel. In order to effect such mounting, the lower half 18 of the front ring includes an upwardly extending notch 26 within which is received a mounting hub 28. A pin 30 extends through the hub and across the slot as shown in FIG. 3. One end of the pin is provided with a screwdriver slot 32, while the opposite end is internally threaded to receive a screw 34. The aperture in the lower half within which the pin 30 is received has a narrowed neck portion just beneath the head of the screw 34 to limit axial movement of the pin toward the right as viewed in FIG. 3, whereby tightening of screw 34 will lock in the lower half of the front ring. The external diameter of the pin is such that it is a snug fit within the lower half of the front ring as well as in the hub 28, so that there is no looseness between the parts. However, the hub 28 is capable of rocking relative to the front ring within the slot 26 and about the axis formed by the pin 30.

The front ring 10 and the rear ring 12 may desirably be supported on the rifle by a detachable type base such as a Redfield dovetail type base or a Weaver detachable base. The Redfield and Weaver bases are standard in the trade and need not be described in detail. Either type base is secured to the rifle and the rings are secured to the base. A representative such base is indicated by the letter B in the drawings. The base forms no part of the invention and therefore is not described in detail except to the extent hereinafter mentioned.

As shown in FIGS. 2 and 3, the hub 28 has a narrowed neck portion 36 which is wedge-shaped as shown in FIG. 2, having opposed inclined surfaces 38 and 40. Such inclined surfaces cooperate with complementary surfaces in the base B to lock the neck portion 36 in the base. The specific configuration of the mounting of the hub in the base is not critical to the invention except that the hub must be securely fastened within the base against unintended relative motion. The hub may be secured to the rifle in any suitable fashion, and that disclosed is simply one possible approach.

Figure 4:
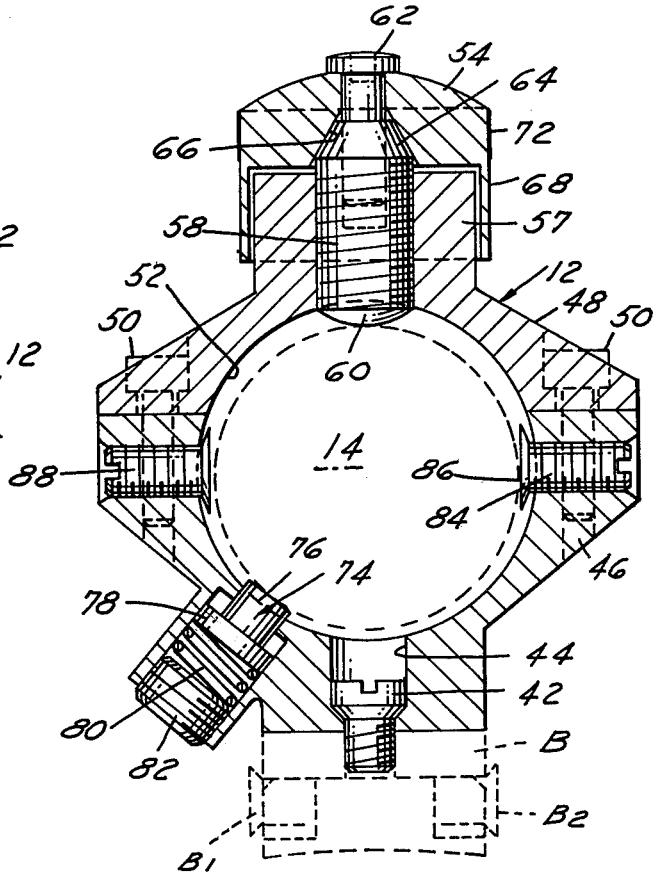
FIG. 4 is a cross-sectional view taken on a line 4—4 of FIG. 2.

The rear ring is secured by screws or the like, one of which is shown at 42, to the base B. Though forming no part of the invention, it may be pointed out that where the screws 42 connect to base B, the base has provision for a lateral adjustment by elements $B_1$ and $B_2$ whereby the scope may be transversely aligned to be parallel with a vertical plane coincident with the longitudinal axis of the gun barrel. The screws 42 are disposed within provided recesses 44 in the lower half 46 of the rear ring. Upper half 48 is removably secured to lower half 46 by four screw fasteners 50 which, upon removal, permit the halves to be separated to allow placement of the scope within the ring. The internal diameter surface 52 of the rear ring is oversize the scope 14 as best shown in FIG. 4 when the ring halves are clamped together, whereby the scope may move vertically within the rear ring.

Figure 5:
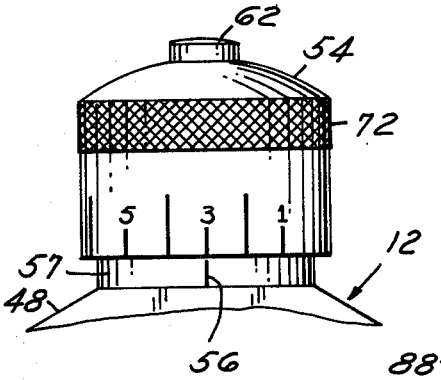
FIG. 5 is a fragmentary detail of the dial showing the distance calibrations.

Means are provided on the rear ring for vertically adjustably positioning the scope 14 within the ring. Such means includes a manually operable cup-shaped dial 54 which is graduated in distance increments, for example, in 100-yard increments, as best shown in FIG. 5, where 100-, 300- and 500-yard increments are designated by the corresponding numerals 1, 3 and 5, and the intermediate lines indicate the even yardage therebetween. A reference indicia 56 on an upstanding boss 57 on the upper half 48 faces rearwardly to enable the shooter to set the dial 54 at a determined position in accordance with the range to be shot. It is desirable that the dial be graduated between, for example, 100 and 1,000 yards, and that the indicia substantially encircle the dial whereby a 360° rotation thereof will cover the intended range.

The vertical adjustment means further includes a threaded screw member 58 which is threadedly received in the boss 57 of the rear ring and is provided with a convex end 60 adapted to bear against the top of scope 14. A threaded fastener 62 holds the dial 54 on the threaded member 58. Relative rotation between the dial and threaded member is prevented by cooperating tapers 64 on the threaded member and 66 within the cap which, when mated, and pulled together by the fastener 62, securely lock the elements against relative movement. The threads on the member 58 are protected against contamination by the interfitting relation between the cup-shaped dial 54 and the boss 57. As shown in FIG. 4, the dial has a circumaxial skirt 68 which surrounds the boss 57. The dial may be knurled as at 72 to facilitate manual gripping and rotation.

The threads on screw member 58 and the mating threads within the boss 57 are designed to have a pitch compensating for bullet drop at varying ranges. By selecting the proper pitch, compensation may be effected for various weight bullets, for example for bullets from 55 grams as might be used with a 0.22 calibre rifle to 180 grams as might be used with a 0.308 Winchester. The thread direction is such that as the dial 54 is turned to increase the range indicia, the scope will be permitted to rise at the rear end while, when the range is decreased, the rear end of the scope is depressed.

In order to hold the scope against the convex end 60 of threaded member 58 so that rotation thereof will serve to cause corresponding vertical adjustments of the scope, the adjusting means includes a resilient element in the form of a springloaded pad 74. The pad includes a narrow neck portion 76 and a head portion 78. The neck portion 76 extends through a provided aperture in the lower half 46 and the end bears against scope 14. A coil compression spring 80 bears against the head 78 and a screw threaded member 82 threaded into the lower half 46 holds the spring in place.

The vertical adjusting means also includes a fixed pad comprising a threaded member 84 having a head provided with a face 86 adapted to bear against the side of the scope opposite the springloaded element 74. The fixed pad is adjusted initially to locate the scope 14 in proper transverse alignment with the mounting ring and thereafter need not be further disturbed during use of the mount. The resultant force vector between the springloaded element 74 and the fixed pad 86 urges the scope 14 continuously upwardly against the convex end 60 of the threaded member 58. Another fixed pad 88 may be provided opposite the pad 84. Pad 88 is normally spaced slightly from the scope 14 to permit the scope to float under the control of the threaded member 58 between the resilient pad 74 and fixed pad 84. Pad 88 is provided simply to limit lateral movement of the rear of the scope should it be accidentally bumped during use of the gun. The scope will normally bear against only the elements 58, 74 and 84.

In use, it will be observed from a study of FIG. 2, that upon rotation of the dial 54 the rear end of the scope, i.e., that to the lefthand side of such figure of the drawings, will be raised or lowered, depending upon the direction of rotation of the dial, and the scope will be permitted to rock about the pivot formed by the pin 30 at the front ring. The locking engagement of the front ring about the scope will prevent the scope from shifting axially on the gun during recoil thereof and thus the scope will be fixedly locked in proper position on the gun. From a manufacturing standpoint, the only variation in the design needed to adapt the mount to various bullet weights is in the pitch of the threads on the screw member 58 and within the boss 57.

I claim:

1. A bullet drop compensating scope mount comprising, in combination:

front and rear scope supporting rings each having separable upper and lower halves, enabling a scope to be mounted therein;

the front ring internally sized to grippingly lock on a scope to prevent relative motion between the scope and ring;

means for mounting said front ring on a rifle for fore and aft rocking motion about a transverse pivot;

the rear ring internally sized to allow relative vertical and lateral movement of a scope embraced thereby when such ring is mounted on a rifle;

means on the rear ring for vertically adjustably positioning a scope therein, characterized by a dial graduated in distance increments and a vertical adjusting screw having a thread pitch corresponding to a determined bullet weight to be fired from a rifle on which the scope is mounted, with the dial connected to the screw;

a pair of positioning pads within the rear ring disposed on opposite lateral sides of a scope mounted in the ring with one of the pads being laterally adjustable and disposed against the scope and the opposite pad spaced closely from the scope for limiting lateral movement of a scope; and a resilient element in the rear ring for urging a scope embraced by the ring against said one pad and against said adjusting screw to hold the scope continually thereagainst.

* * * * *